US008104444B2

(12) United States Patent
Schultz

(10) Patent No.: US 8,104,444 B2
(45) Date of Patent: Jan. 31, 2012

(54) PRE-CHAMBER IGNITER HAVING RF-AIDED SPARK INITIATION

(75) Inventor: James M. Schultz, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 1126 days.

(21) Appl. No.: 11/980,411

(22) Filed: Oct. 31, 2007

(65) Prior Publication Data

US 2009/0107439 A1 Apr. 30, 2009

(51) Int. Cl.
*F02P 23/00* (2006.01)
*F02M 57/06* (2006.01)

(52) U.S. Cl. ..... 123/143 B; 123/297; 123/606; 123/608; 123/266

(58) Field of Classification Search ..... 123/266, 123/297, 143 B, 169 MG, 606, 608
See application file for complete search history.

(56) References Cited

U.S. PATENT DOCUMENTS

| | | | | |
|---|---|---|---|---|
| 3,934,566 | A | 1/1976 | Ward | |
| 4,138,980 | A | 2/1979 | Ward | |
| 4,265,201 | A | 5/1981 | Gerry | |
| 4,766,861 | A | 8/1988 | Finsterwalder | |
| 4,930,473 | A * | 6/1990 | Dietrich | 123/266 |
| 5,105,780 | A * | 4/1992 | Richardson | 123/263 |
| 5,554,908 | A * | 9/1996 | Kuhnert et al. | 313/140 |
| 5,655,210 | A | 8/1997 | Gregoire et al. | |
| 5,845,480 | A | 12/1998 | DeFreitas et al. | |
| 5,983,871 | A | 11/1999 | Gordon et al. | |
| 6,883,507 | B2 | 4/2005 | Freen | |
| 7,770,552 | B2 * | 8/2010 | Schultz | 123/143 B |
| 2009/0107437 | A1 * | 4/2009 | Schultz | 123/143 B |
| 2010/0147259 | A1 * | 6/2010 | Kuhnert et al. | 123/260 |

OTHER PUBLICATIONS

Paul D. Freen, "Radio Frequency Electrostatic Ignition System Feasibility Demonstration", Energy Innovations Small Grant (EISG) Program, EISG Final Report, EISG Awardee (Aug. 2003-May 2005).

* cited by examiner

*Primary Examiner* — Hai Huynh
(74) *Attorney, Agent, or Firm* — Finnegan, Henderson, Farabow, Garrett & Dunner LLP

(57) ABSTRACT

An igniter for an internal combustion engine is disclosed. The igniter may have a body, and a pre-combustion chamber integral with the body and having at least one orifice. The igniter may also have at least one electrode associated with the pre-combustion chamber. The at least one electrode may be configured to direct RF energy to lower an ignition breakdown voltage requirement of an air and fuel mixture in the pre-combustion chamber. The RF energy alone may be insufficient to ignite and sustain combustion of the air and fuel mixture. The at least one electrode may also be configured to generate an arc that extends to an internal wall of the pre-combustion chamber and ignites the air and fuel mixture.

17 Claims, 3 Drawing Sheets

PRE-CHAMBER IGNITER HAVING RF-AIDED SPARK INITIATION

TECHNICAL FIELD

The present disclosure is directed to a pre-chamber igniter and, more particularly, to a pre-chamber igniter having RF-aided spark initiation.

BACKGROUND

Engines, including diesel engines, gasoline engines, gaseous fuel powered engines, and other engines known in the art ignite injections of fuel to produce heat. In one example, fuel injected into a combustion chamber of the engine is ignited by way of a spark plug. The heat and expanding gases resulting from this combustion process may be directed to displace a piston or move a turbine blade, both of which can be connected to a crankshaft of the engine. As the piston is displaced or the turbine blade is moved, the crankshaft is caused to rotate. This rotation may be utilized to directly drive a device such as a transmission to propel a vehicle, or a generator to produce electrical power.

During operation of the engine described above, a complex mixture of air pollutants is produced as a byproduct of the combustion process. These air pollutants are composed of solid particulate matter and gaseous compounds including nitrous oxides (NOx). Due to increased attention on the environment, exhaust emission standards have become more stringent and the amount of solid particulate matter and gaseous compounds emitted to the atmosphere from an engine is regulated depending on the type of engine, size of engine, and/or class of engine.

One method that has been implemented by engine manufacturers to reduce the production of these pollutants is to introduce a lean air/fuel mixture into the combustion chambers of the engine. This lean mixture, when ignited, burns at a relatively low temperature. The lowered combustion temperature slows the chemical reaction of the combustion process, thereby decreasing the formation of regulated emission constituents. As emission regulations become stricter, leaner and leaner mixtures are being implemented.

Although successful at reducing emissions, very lean air/fuel mixtures are difficult to ignite. That is, the single point arc from a conventional spark plug may be insufficient to initiate and/or maintain combustion of a mixture that has little fuel (compared to the amount of air present). As a result, the emission reduction available from a typical spark-ignited engine operated in a lean mode may be limited. In addition, conventional spark plugs suffer from low component life due to the associated high breakdown voltage requirement of the arc.

One attempt at improving combustion initiation of a lean air/fuel mixture is described in U.S. Pat. No. 3,934,566 (the '566 patent) issued to Ward on Jan. 27, 1976. The '566 patent discloses a system for use with a controlled vortex combustion chamber (CVCC) engine having a main combustion chamber, a pre-combustion chamber, and one spark plug located in each of the combustion and pre-combustion chambers. The system couples high frequency electromagnetic energy (RF energy) into the pre-combustion chamber either through the associated spark plug or in the vicinity of the spark plug tip. The RF energy is produced by magnetrons or microwave solid-state devices, and can act in conjunction with the mechanically linked action of the typical distributor rotor shaft to obtain timing information therefrom. The system concentrates on using the RF energy to create a plasma mixture of air and fuel before, after, or before and after the instant the pre-combustion chamber is fired by means of an arc at the spark plug tip. The presence of the microwave energy at or near the spark plug tip modifies the voltage required for firing and facilitates ignition of a lean air/fuel mixture. It may even be possible to eliminate the arc altogether by using microwave sources in a pulsed mode and by designing the spark plug tip in such a manner that it both couples microwave energy efficiently to the air-fuel plasma mixture as a whole, as well as produces large electric fields at the highly localized region of the spark plug tip. The RF energy is coupled to the spark plug in the pre-combustion chamber, as compared to the combustion chamber, because the pre-combustion chamber contains an ignitable richer mixture.

Although the system of the '566 patent may improve combustion of a lean air/fuel mixture and, in one embodiment, may have an affect on the damage caused by high temperature arcing, the system may still be problematic and have limited applicability. For example, the amount of power and the voltage level required to produce a plasma of the air/fuel mixture and to ignite the mixture may be at least partially dependent on the volume of the mixture. That is, a large combustion chamber volume may require a large amount of power and high voltage levels to sufficiently ionize and ignite the air/fuel mixture within the chamber. Thus, although the system of the '566 patent may, in one embodiment, reduce the power requirement through the use of an engine's pre-combustion chamber, the required power and voltage levels may still be very high. And, in engines without pre-combustion chambers, the system of the '566 patent may require prohibitively large amounts of power and excessive voltage levels to ionize and ignite a lean air/fuel mixture within the larger combustion chambers.

The igniter of the present disclosure solves one or more of the problems set forth above.

SUMMARY

One aspect of the present disclosure is directed to an igniter. The igniter may include a body, and a pre-combustion chamber integral with the body and having at least one orifice. The igniter may also include at least one electrode associated with the pre-combustion chamber. The at least one electrode may be configured to direct RF energy to lower an ignition breakdown voltage requirement of an air and fuel mixture within the pre-combustion chamber. The RF energy may, alone, be insufficient to ignite and sustain combustion of the air and fuel mixture. The at least one electrode may also be configured to generate an arc that extends to an internal wall of the pre-combustion chamber and ignites the air and fuel mixture.

Another aspect of the present disclosure is directed to a method of operating an engine. The method may include generating a current having a voltage component in the RF range, and directing the current into a pre-combustion chamber separate from the engine to produce a corona. The method may also include generating an arc to ignite an air and fuel mixture within the pre-combustion chamber, and directing a flame jet from the pre-combustion chamber into the engine. The current having the voltage component in the RF range may, alone, be insufficient to ignite the air and fuel mixture.

DETAILED DESCRIPTION

Figure 1:
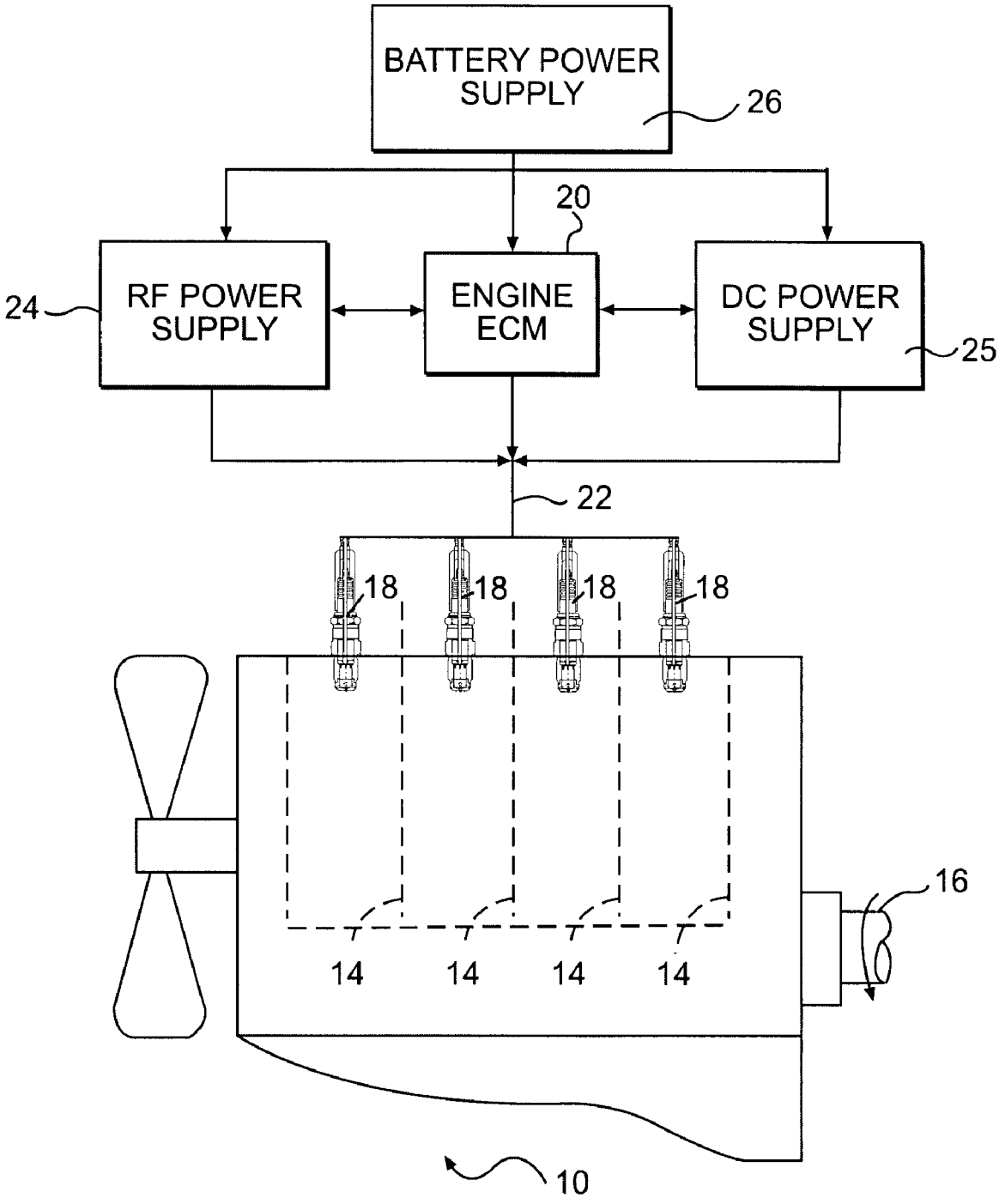
FIG. 1 is a schematic and diagrammatic illustration of an exemplary disclosed power system.

FIG. 1 illustrates a power system 10. Power system 10 may be any type of internal combustion engine such as, for example, a gasoline engine, a gaseous fuel-powered engine, or a diesel engine. Power system 10 may include an engine block that at least partially defines a plurality of combustion chambers 14. In the illustrated embodiment, power system 10 includes four combustion chambers 14. However, it is contemplated that power system 10 may include a greater or lesser number of combustion chambers 14, and that combustion chambers 14 may be disposed in an "in-line" configuration, a "V" configuration, or in any other suitable configuration.

As also shown in FIG. 1, power system 10 may include a crankshaft 16 that is rotatably disposed within the engine block. A connecting rod (not shown) may connect a plurality of pistons (not shown) to crankshaft 16 so that a sliding motion of each piston within the respective combustion chamber 14 results in a rotation of crankshaft 16. Similarly, a rotation of crankshaft 16 may result in a sliding motion of the pistons.

An igniter 18 may be associated with each combustion chamber 14. Igniter 18 may facilitate ignition of fuel sprayed into combustion chamber 14 during an injection event, and may be timed to coincide with the movement of the piston. Specifically, the fuel within combustion chamber 14, or a mixture of air and fuel, may be ignited by a flame jet propagating from igniter 18 as the piston nears a top-dead-center position during a compression stroke, as the piston leaves the top-dead-center position during a power stroke, or at any other appropriate time.

To facilitate the appropriate ignition timing, igniter 18 may be in communication with and/or actuated by an engine control module (ECM) 20 via a power supply and communication harness 22. Based on various input received by ECM 20 including, among other things, engine speed, engine load, emissions production or output, engine temperature, engine fueling, and boost pressure, ECM 20 may selectively direct a current from an RF power supply 24 and a DC power supply 25 to each igniter 18 via harness 22. It is contemplated that RF power supply 24 and DC power supply 25 may be combined into a single integral unit, if desired.

ECM 20 may include all the components required to run an application such as, for example, a memory, a secondary storage device, and a processor, such as a central processing unit. One skilled in the art will appreciate that the ECM 20 can contain additional or different components. ECM 20 may be dedicated to control of only igniters 18 or, alternatively, may readily embody a general machine or power system microprocessor capable of controlling numerous machine or power system functions. Associated with ECM 20 may be various other known circuits such as, for example, power supply circuitry, signal conditioning circuitry, and solenoid driver circuitry, among others.

A common source, for example an onboard battery power supply 26, may power any or all of ECM 20, RF power supply 24, and DC power supply 25. In typical vehicular applications, battery power supply 26 may provide 12 or 24 volt current. RF power supply 24 may receive the electrical current from battery power supply 26 and transform the current to an energy level usable by igniters 18 to ionize (i.e., create a corona in) an air and fuel mixture. For the purposes of this disclosure, high frequency energy or RF energy may be considered electromagnetic energy having a frequency in the range of about 50-3000 kHz and a voltage of up to about 50,000 volts or more. RF power supply 24 may transform the low voltage current from battery power supply 26 to RF energy through the use of magnetrons, microwave solid state devices, oscillators, and other devices known in the art. It should be noted that the RF energy from power supply 24 may, alone, be insufficient to ignite the air and fuel mixture. The purpose of ionizing the air and fuel mixture may be to reduce an ignition breakdown voltage requirement thereof below an igniter damage threshold. It should be noted that, during operation of power system 10, ECM 20, RF power supply 24, and DC power supply 25 may receive power from an alternator (not shown) in addition to or instead of battery power supply 26, if desired.

DC power supply 25 may include, among other things a high voltage source of DC power as is typical in most spark-ignited, combustion engine applications. In one embodiment, multiple high voltage sources may be present, with one high voltage source being paired with one igniter 18. In another embodiment, a single high voltage source of DC power may be utilized for all igniters 18. In this configuration, a distributor (not shown) may be located between the high voltage source and igniters 18 to selectively distribute power to each igniter 18 at an appropriate timing relative to the motion of the engine's pistons. DC power supply 25 may generate a high voltage DC current having a frequency below the RF range, and direct this current to igniters 18. It should be noted that the arc generated within igniter 18 by DC power supply 25 may, alone, be insufficient to ignite an air and fuel mixture that has not been ionized. That is, DC power supply 25 may be intended for use with RF power supply 24 and, thus, benefit from the corona generated within igniter 18. In other words, the ignition breakdown voltage of the arc generated by igniter 18, as a result of receiving current from DC power supply 25, may be significantly lower than the an arc generated by a typical spark plug powered by a conventional high voltage DC power source.

Figure 2:
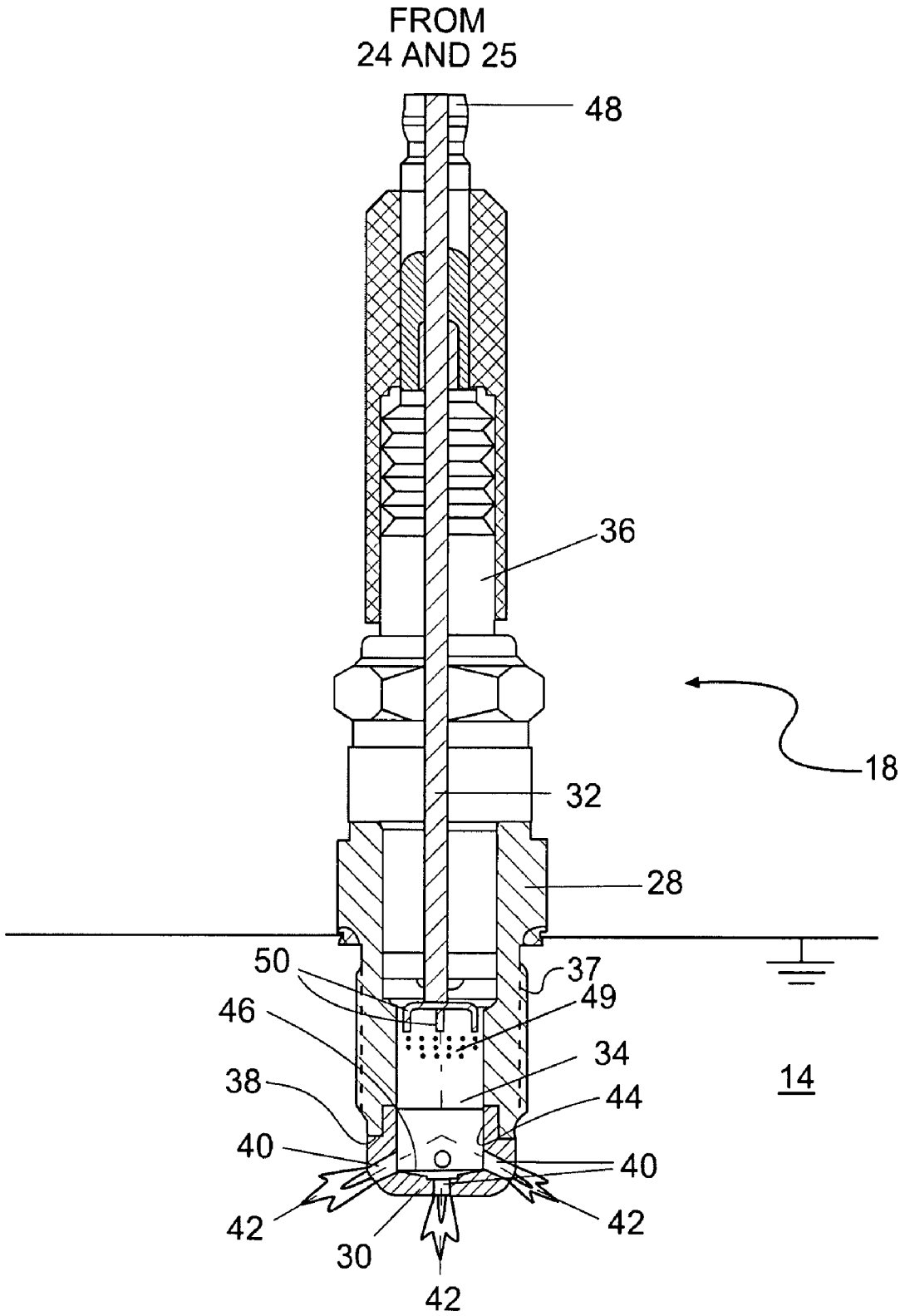
FIG. 2 is a cross-sectional illustration an exemplary disclosed igniter that may be used with the power system of FIG. 1.

As illustrated in FIG. 2, igniter 18 may include multiple components that cooperate to ignite the air and fuel mixture within combustion chamber 14. In particular, igniter 18 may include a body 28, a cap 30, and a single electrode 32. Body 28 may be generally hollow at one end and, together with cap 30, may at least partially define an integral pre-combustion chamber 34 (also known as a pre-chamber). Electrode 32 may extend from a terminal end 48 of igniter 18 through body 28 and at least partially into pre-combustion chamber 34. In one embodiment, an insulator 36 may be disposed between body 28 and electrode 32 to electrically isolate electrode 32 from body 28.

Body 28 may be a generally cylindrical structure fabricated from an electrically conductive material. In one embodiment, body 28 may include external threads 37 configured for direct engagement with an engine block or with a cylinder head (not shown) fastened to the engine block to cap off combustion chamber 14. In this configuration, body 28 may be electrically grounded via the connection with the engine block or the cylinder head.

Cap 30 may have a cup-like shape and be fixedly connected to an end 38 of body 28. Cap 30 may be welded, press-fitted, threadingly engaged, or otherwise fixedly connected to body 28. Cap 30 may include a plurality of orifices 40 that facilitate the flow of air and fuel into pre-combustion chamber 34 and the passage of flame jets 42 from pre-combustion chamber 34 into combustion chamber 14 of the engine block. Orifices 40 may pass generally radially through an annular side wall 44 of cap 30 and/or through an end wall 46 of cap 30.

Electrode 32 may be fabricated from an electrically conductive metal such as, for example, tungsten, iridium, silver, platinum, and gold palladium, and be configured to direct current from RF power supply 24 to ionize (i.e., create a corona 49 within) the air and fuel mixture of pre-combustion chamber 34, and to direct DC current from power supply 25 to ignite the air and fuel mixture. In one embodiment, a plurality of prongs 50 may extend generally radially toward an internal wall of pre-combustion chamber 34, such that the RF energy and DC current may be substantially distributed toward the internal wall.

Figure 3:
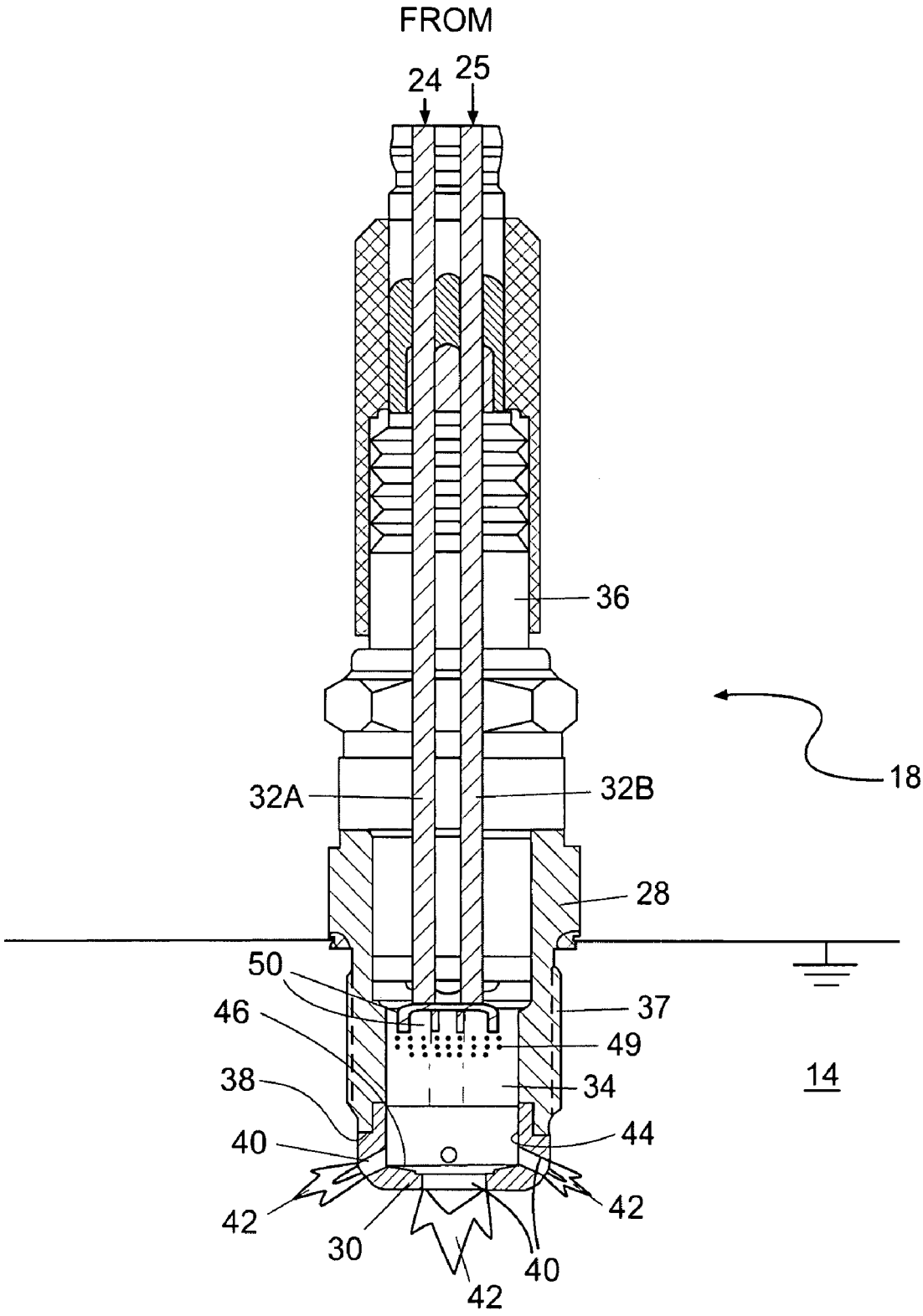
FIG. 3 is a cross-sectional illustration of another exemplary disclosed igniter that may be used with the power system of FIG. 1.

FIG. 3 illustrates another embodiment of igniter 18. Similar to the embodiment of FIG. 2, igniter 18 of FIG. 3 may include body 28, cap 30, and integral pre-combustion chamber 34. However, in contrast to the embodiment of FIG. 2, igniter 18 of FIG. 3 may include a first electrode 32*a* associated with RF power supply 24, and a second electrode 32*b* associated with DC power supply 25. By utilizing separate electrodes 32, each individual electrode 32*a*, 32*b* may be tailored efficiently and economically to meet the needs of the current each individual electrode may be transmitting. Although shown adjacent each other, electrodes 32*a*, 32*b* could alternatively be located concentrically, if desired. Similarly, although prongs 50 of each electrode 32*a* and 32*b* are shown as being located at about the same axial location, the prongs 50 of one electrode 32 may be axially offset relative to the prongs 50 of the other electrode 32, if desired.

INDUSTRIAL APPLICABILITY

The igniter of the present disclosure may be applicable to any combustion-type power source. Although particularly applicable to low NOx engines operating on lean air and fuel mixtures, the igniter itself may be just as applicable to any combustion engine where component life of the igniter is a concern. The disclosed igniter may facilitate combustion of the lean air and fuel mixture by ionizing the mixture prior to and/or during ignition of the mixture. Component life may be improved by lowering the required breakdown voltage through the use of a corona. And, by utilizing an integral pre-combustion chamber, the amount of energy required by the disclosed igniter for these processes may be low. The operation of power system 10 will now be described.

Referring to FIG. 1, air and fuel may be drawn into combustion chambers 14 of power system 10 for subsequent combustion. Specifically, fuel may be injected into combustion chambers 14 of power system 10, mixed with the air therein (or, alternatively premixed with the air and then introduced into combustion chambers 14), and combusted by power system 10 to produce a mechanical work output and an exhaust flow of hot gases.

Referring to FIGS. 2 and 3, as the injected fuel within combustion chambers 14 mixes with air, some of the mixture may enter pre-combustion chamber 34 of igniter 18 via orifices 40 during an intake and/or compression stroke of the associated piston. At an appropriate timing relative to the motion of the pistons within combustion chambers 14, as detected or determined by ECM 20, ECM 20 may control RF power supply 24 to direct a first current to igniters 18. The first current, having voltage components in the RF energy range, may generate a corona at prongs 50 within pre-combustion chamber 34. This first current may help to lower an ignition breakdown voltage requirement of the air and fuel mixture.

When sufficient RF energy has been directed into pre-combustion chamber 34 (or during the direction of RF energy into pre-combustion chamber 34), ECM 20 may control DC power supply 25 to direct a second current to igniters 18. The second current, having voltage components below the RF energy range, may produce a high temperature arc that extends from electrode 32 (electrode 32*b* with respect to the embodiment of FIG. 3), to internal walls of pre-combustion chamber 34. This high temperature arc, although at a lower temperature than typical spark plugs, may be sufficient to ignite the already ionized (or currently ionizing) mixture of air and fuel. As the air and fuel mixture ignites within pre-combustion chamber 34, flame jets 42 may propagate through orifices 40 into combustion chambers 14 of the engine block, where the remaining air and fuel mixture may be efficiently combusted.

It will be apparent to those skilled in the art that various modifications and variations can be made to the igniter of the present disclosure without departing from the scope of the disclosure. Other embodiments will be apparent to those skilled in the art from consideration of the specification and practice of the igniter disclosed herein. It is intended that the specification and examples be considered as exemplary only, with a true scope of the disclosure being indicated by the following claims and their equivalents.

What is claimed is:

1. An igniter, comprising:

a body;

a pre-combustion chamber integral with the body and having at least one orifice; and at least one electrode associated with the pre-combustion chamber and being configured to:

direct RF energy to lower an ignition breakdown voltage requirement of an air and fuel mixture in the pre-combustion chamber, the RF energy alone being insufficient to ignite and sustain combustion of the air and fuel mixture;

the RF energy creating a corona within the pre-combustion chamber; and generate an arc that extends to an internal wall of the pre-combustion chamber and ignites the air and fuel mixture.

2. The igniter of claim 1, wherein the arc is insufficient to ignite and sustain combustion of the air and fuel mixture without the ignition breakdown voltage requirement of the air and fuel mixture being lowered by the RF energy.

3. The igniter of claim 1, wherein the at least one electrode includes a plurality of prongs extending radially toward an annular wall of the integral pre-combustion chamber.

4. The igniter of claim 1, wherein the at least one electrode includes a single electrode.

5. The igniter of claim 1, wherein the at least one electrode includes a plurality of electrodes, at least a first of the plurality of electrodes being associated with direction of the RF energy, and at least a second of the plurality of electrodes being associated with generation of the arc.

6. The igniter of claim 1, further including a cap configured to substantially close off a recess in the body to at least partially define the pre-combustion chamber, wherein the at least one orifice includes a plurality of orifices extending through the cap.

7. The igniter of claim 1, wherein the air and fuel mixture is lean.

8. The igniter of claim 1, wherein at least one flame jet resulting from ignition of the air and fuel mixture passes from the pre-combustion chamber through the at least one orifice.

9. The igniter of claim 1, wherein the RF energy is distributed toward the wall of the pre-combustion chamber.

10. The igniter of claim 9, wherein the wall of the pre-combustion chamber is electrically grounded.

11. A method of operating an engine, comprising:

generating a current having a voltage component in the RF range;

directing the current into a pre-combustion chamber separate from the engine to produce a corona;

generating an arc to ignite an air and fuel mixture within the pre-combustion chamber; and directing a flame jet from the pre-combustion chamber into the engine, wherein the current having the voltage component in the RF range is alone insufficient to ignite the air and fuel mixture.

12. The method of claim 11, wherein the current having the voltage component in the RF range lowers an ignition breakdown voltage requirement of the air and fuel mixture.

13. The method of claim 12, wherein the arc is insufficient to ignite the air and fuel mixture without the ignition breakdown voltage requirement of the air and fuel mixture being lowered by the current having the voltage component in the RF range.

14. The method of claim 11, wherein the pre-combustion chamber is removably attachable to the engine.

15. The method of claim 11, wherein directing the flame jet includes directing the flame jet to ignite a lean air and fuel mixture within a main combustion chamber of the engine.

16. A power system, comprising:

an engine block at least partially defining a combustion chamber;

a first power source configured to produce a current having a voltage component in the RF range;

a second power source configured to produce a DC current having a voltage component below the RF range; and an igniter fluidly communicated with the combustion chamber and electrically communicated with the first and second power sources, the igniter including:

an integral pre-combustion chamber;

a plurality of orifices fluidly communicating the integral pre-combustion chamber with the combustion chamber of the engine block; and at least one electrode extending at least partially into the integral pre-combustion chamber and being configured to:

direct current from the first power source to lower an ignition breakdown voltage requirement of the air and fuel mixture within the integral pre-combustion chamber to create a corona; and direct current from the second power source to ignite the air and fuel mixture having the lowered ignition breakdown voltage requirement, the second power source being insufficient to ignite and sustain combustion of the air and fuel mixture without the ignition breakdown voltage requirement of the air and fuel mixture being lowered by the current from the first source;

the at least one electrode including a plurality of electrodes, at least a first of the plurality of electrodes being associated with the first power source, and at least a second of the plurality of electrodes being associated with the second power source.

17. The power source of claim 16, wherein the at least one electrode includes a single electrode.

* * * * *